United States Patent [19]

Eickholt et al.

[11] 4,100,061

[45] Jul. 11, 1978

[54] SEPARATOR

[75] Inventors: Hubert Eickholt, Neubeckum; Günter Heinzel, Ahlen, both of Fed. Rep. of Germany

[73] Assignee: Polysius AG, Neubeckum, Fed. Rep. of Germany

[21] Appl. No.: 724,272

[22] Filed: Sep. 20, 1976

[30] Foreign Application Priority Data

Oct. 24, 1975 [DE] Fed. Rep. of Germany ..... 2547709

[51] Int. Cl.[2] ..... B07B 7/08

[52] U.S. Cl. ..... 209/139 A; 209/148

[58] Field of Search ..... 209/139 A, 148, 463, 209/464, 505; 74/664, 665 F, 665 K; 417/360, 361

[56] References Cited

U.S. PATENT DOCUMENTS

| | | | |
|---|---|---|---|
| 1,346,015 | 7/1920 | Gibson et al. | 209/148 |
| 2,188,634 | 1/1940 | Sturtevant | 209/139 A |
| 3,053,044 | 9/1962 | Gresty | 74/664 |
| 3,907,463 | 9/1975 | Eller et al. | 417/360 |

*Primary Examiner*—Frank W. Lutter
*Assistant Examiner*—Jon Hokanson
*Attorney, Agent, or Firm*—Jones, Thomas & Askew

[57] ABSTRACT

This invention relates to a separator with a vertical axis, with a fan for producing the separating air stream coaxially disposed on a hollow shaft in the separator housing, a scatter plate rotating in the separator chamber, a counter-impeller system also rotating in the separator chamber, together with a drive mechanism mounted on the separator housing cover and comprising a drive motor, first gearing coupled with the hollow fan-shaft, and second adjustable gearing which drives the scatter plate and the counter-impeller system through a core shaft coaxially disposed in the hollow fan-shaft.

4 Claims, 1 Drawing Figure

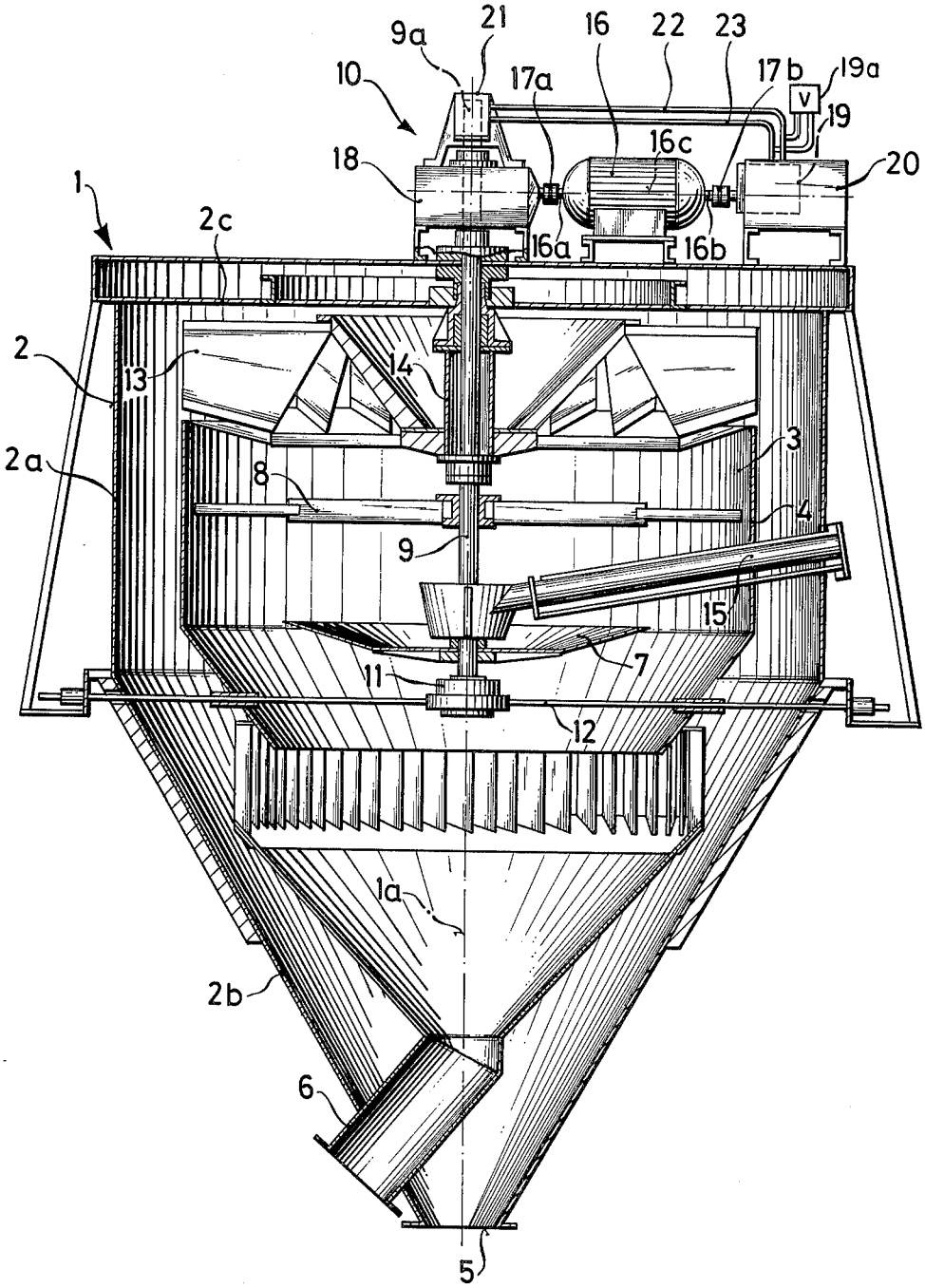
9a
21
16
22
23
10
17a
17b
19a
V
19
16c
18
20
1
2c
16a
16b
2
13
14
2a
3
8
4
9
15
7
11
12
1a
2b
6
5

SEPARATOR

In order that the discrimination with which the material in the separator chamber is sorted according to size and weight in air particles separators of this type can be varied in desired fashion, the rotary speed of the core shaft carrying the scatter plate and the counter-impeller system must be adjustable independently of the rotary speed of the hollow fan-shaft. For this purpose, in known air separator constructions, these two shafts are driven via separate gearings, each associated with its drive motor. Because of their drive systems constructions of this type are therefore relatively expensive, as well as large and heavy.

An air separator construction has also been previously developed wherein the hollow shaft and the core-shaft mounted coaxially therein were provided with a common drive motor whose drive shaft was connected first via a fixed non-adjustable gearing with the hollow fan-shaft and secondly via electrically or mechanically adjustable gearing with the core shaft which carries the scatter plate and the counter-impeller system. In this case the rotary drive speed of the adjustable second gearing is initially set for a constant separation limit between coarse and fine material, and remains the same until changes arise in the material being separated and/or the demarcation boundary, whereupon the air separator with these settings is switched off, and when necessary is set to the new values and re-started.

This invention is based on the problem of further developing an air separator of the type initially described, wherein for the same output and with relatively simple construction the initial cost as compared with known models can be reduced.

According to the invention this problem is substantially solved in that the adjustable second gearing comprises a hydraulic drive whose pump, variable in delivery rate, is coupled to a driven shaft of the drive motor.

While in known air separator constructions a relatively expensive gearing, adjustable mechanically or by electric motor, is used for varying the rotary speed of the core shaft and hence of the scatter-plate and counter-impeller system, in accordance with the invention the same purpose is achieved by using a hydraulic drive, so that the capital costs of the drive mechanism and hence of the entire air separator can be reduced.

Since with this embodiment provided by the invention the drive motor is coupled firstly to the first gearing for the fan and secondly to the hydraulic drive pump, variable in its delivery rate, it is possible to take advantage of the recognition that a considerable reduction in drive motor output can be achieved if when this air separator is started up the majority of or almost the entire drive motor output is used for taking the fan up to its rated running speed, and only when this rated speed has been reached are the hydraulic drive and hence the core shaft with the scatter plate and counter-impeller system brought up to the required running speed by suitable setting of the delivery rate for the variable hydraulic pump. During the starting up of the fan, the delivery rate for the variable pump in the hydraulic drive is therefore set to the minimum driven speed of the hydraulic drive or even to complete stopping of said hydraulic drive. Since the drive force for the fan is appreciably greater in the starting condition than when the fan is running at its rated speed, when the rated rotary speed of the fan is reached on a considerable portion of the drive motor output now becomes free, and hence is available for the hydraulic drive and hence for the bringing up to their operating speed of the scatter plate and counter-impeller system. As compared with known constructions wherein during starting-up of the separator both of the gearings with the parts of the separator they drive are brought simultaneously up to their operating rotary speed, there is thus achieved a considerable drop in drive motor output, which can lead to a smaller drive motor, of lower weight and space requirement and cheaper to manufacture. Furthermore the costs of maintaining the hydraulic drive are also notably less than for previous variable gearings, and a hydraulic drive can be temporarily overloaded by up to 100% and for intermittent shocks even up to 300%.

With the air separator provided by the invention there is admittedly a slight prolongation of the starting-up period; but since an air separator is usually operated for quite long periods and no particularly rapid starting is involved, and since the operation of the air separator is to some extent started in stages, this extension of the starting period is in no way disadvantageous.

One embodiment of the invention will be described in more detail below with reference to the drawing, which shows an air separator in accordance with the invention, partly in vertical section and partly in elevation.

The actual air separator 1, shown merely as an example, has a housing 2 whose cylindrical portion 2*a* surrounds at a distance the wall 4 defining the separator chamber 3. The cylindrical housing portion 2*a* terminates underneath in a funnel portion 2*b* with the fine material outlet 5, with a coarse material outlet pipe 6 passing through the wall of the funnel portion 2*b*.

In the lower area of the separator chamber 3 is a rotating scatter plate 7, while a counter-impeller system 8 is provided in about the central area of separator chamber 3. The scatter plate 7 and counter-impeller system 8 are both affixed to a vertical shaft 9 disposed coaxially in the air separator 1 and also in the separator chamber 3, said shaft being driven by drive means 10 (to be described below) on the cover 2*c* of separator housing 2. The lower end of this vertical shaft 9 is held in a bearing 11 adjustable in known manner by a rod 12.

The upper end of the separator chamber 3 is formed by a fan 13 coaxially disposed in the housing 2 and producing a separating air stream, the fan being mounted on a hollow shaft 14 surrounding and spaced from a shaft 9 forming a core shaft; the hollow shaft and the core shaft 9 are so supported in relation to each other that they can be rotated independently.

With the embodiment shown, the material for separating is supplied via a feed channel 15 (for example a pneumatic feed channel) which passes through the cylindrical housing portion 2*a* and terminates above the scatter plate 7.

The drive means 10, which can be mounted on the housing cover 2*c* in usual manner by angle irons, brackets and the like, includes a drive motor 16 at whose ends are provided driven shaft ends 16*a*, 16*b*: the motor axis 16*c* runs generally horizontal and hence perpendicular to the vertical separator axis 1*a*. The driven shaft end 16*a* is connected by a resilient coupling 17*a* to a tapered spur wheel gearing 18 with a constant rotary speed and whose driven side is fixedly connected to the hollow fan-shaft 14. This spur wheel gearing 18 also has passing through it the upper end 9*a* of the core shaft 9, which projects from the top of gearing 18.

With this form of separator provided by the invention there is also provided an adjustable second gearing, comprising a hydraulic drive. This hydraulic drive consists in general of a hydraulic pump 19 of variable delivery rate, a hydraulic fluid storage container 20 which also holds the pump, and a hydraulic motor 21 connected via hydraulic inlet and oulet conduits 22, 23 to the hydraulic pump and mounted on the end 9*a* of the core shaft projecting from the top of gearing 18, being supported on the top of the spur wheel gearing 18. The hydraulic pump 19 is drivably connected via a further resilient coupling 17*b* to the other driven shaft end 16*b* of the drive motor 16. The delivery rate of hydraulic pump 19 can be altered by setting means 19*a* known per se and not shown in detail, so that the change in the hydraulic fluid (eg. oil) delivered by the pump 19 causes the driven speed of the hydraulic motor 21 and hence the rotary drive speed of the core shaft 9 which drives the scatter plate 7 and counter-impeller system 8 to be altered in the particular manner desired.

The air separator 1 in accordance with the invention is so operated that when started up the fan 13 is first brought to its rated rotary speed (by hollow shaft 14, spur-wheel gearing 18 and the driven shaft end 16*a* of the drive motor 16), while during this period the core-shaft 9 with scatter plate 7 and counter-impeller system 8 are only driven by the hydraulic drive (19, 20, 21) at minimum rotary speed or not at all, and the hydraulic drive for driving core shaft 9 with scatter plate 7 and the counter-impeller system are only switched to full operating speed when or shortly before the fan has reached its rated rotary speed. Hence the major part or almost the entire output of the drive motor 16 can initially be used for the high power consumption of fan 13 as it starts up, whereafter once the fan has reached, or almost reached, its rated rotary speed, and hence needs to consume less power, the part of the drive power now freed can be utilized for starting up, and subsequently running, the scatter plate 7 and counter-impeller system 8. The switching of the hydraulic drive after the fan reaches its rated rotary speed from the initially small rotary speed or state of rest to the rotary speed required in operation to drive core shaft 9 can be effected manually or by control means (not shown in detail in the drawing) for automatically controlling the pump operation. Such control means can respond automatically when the fan has reached its rated running speed or nearly so, depending on the setting, and can at the same time ensure that when the air separator 1 is switched off, the delivery rate of the hydraulic pump 19 is automatically returned to its starting condition for putting the separator into operation.

While with the mode of operation described above the putting of the air separator 1 into operation is performed in practice in two stages, the starting procedure for the two driven shafts, hollow shaft 14 and core shaft 9, can also be controlled in several stages or substantially continuously in dependence on the state of starting reached by fan 13 and the power therefore available, so that the starting of the air separator as a whole can be accelerated accordingly.

It is evident that any suitable commercial components can be used in the hydraulic drive; the hydraulic motor may for example comprise a radial piston hydraulic motor.

What we claim is:

1. A particles separator comprising a housing defining a circular side wall extending about a vertical axis, a circular separator chamber coaxially disposed within said circular side wall of said housing, a hollow shaft rotatable about said axis, a centrifugal fan in said housing at the upper portion of said separator chamber supported by and rotatable with said hollow shaft about said axis for producing an air stream in an upward direction through said separator chamber, a core shaft mounted concentrically in said hollow shaft and rotatable independently with respect to said hollow shaft about said axis, a scatter plate positioned below said centrifugal fan and supported by and rotatable with said core shaft about said axis, an impeller positioned between said centrifugal fan and said scatter plate and supported by and rotatable with said core shaft about said axis, drive means mounted on said housing and comprising a drive motor, first drive connection means connected between said drive motor and said hollow shaft for rotating said centrifugal fan, and second drive connection means connected between said drive motor and said core shaft for rotating said scatter plate and said impeller, said second drive connection means comprising a hydraulic pump driven by said drive motor, a hydraulic motor in driving connection with said core shaft and driven by said hydraulic pump, and flow control means for selectively varying the speed of said hydraulic motor with respect to said hydraulic pump whereby the drive motor is operated to rotate the hollow shaft and fan up to a desired speed of rotation and the flow control means is selectively operated to vary the driven speed of the hydraulic motor, core shaft, scatter plate and impeller independently of the rotation of the hollow shaft and fan.

2. The separator as in claim 1 and further including a hydraulic fluid storage container, and wherein said pump is housed in said hydraulic fluid storage container.

3. The separator as in claim 1 and wherein said hydraulic motor is mounted on the upper end of the core shaft.

4. The separator as in claim 1 and wherein said drive motor has a driven shaft with two driven shaft ends at each axial end with each shaft end being connected by a resilient coupling to each one of said drive connection means, and said motor shaft is disposed perpendicular to the vertical axis of said air separator.

* * * * *